US010648775B2

(12) United States Patent
Sullivan

(10) Patent No.: US 10,648,775 B2
(45) Date of Patent: May 12, 2020

(54) APPARATUS FOR CORRECTING BALLISTIC AIM ERRORS USING SPECIAL TRACERS

(71) Applicant: Kevin Michael Sullivan, Kennebunk, ME (US)

(72) Inventor: Kevin Michael Sullivan, Kennebunk, ME (US)

(73) Assignee: Nostromo Holdings, LLC, Alexandria, VA (US)

( * ) Notice: Subject to any disclaimer, the term of this patent is extended or adjusted under 35 U.S.C. 154(b) by 0 days.

(21) Appl. No.: 15/706,856

(22) Filed: Sep. 18, 2017

(65) Prior Publication Data

US 2019/0025014 A1 Jan. 24, 2019

Related U.S. Application Data

(63) Continuation of application No. 14/220,404, filed on Mar. 20, 2014, now abandoned.

(60) Provisional application No. 61/803,826, filed on Mar. 21, 2013.

(51) Int. Cl.
*F41G 3/14* (2006.01)
*F42B 12/38* (2006.01)

(52) U.S. Cl.
CPC ..... *F41G 3/142* (2013.01); *F42B 12/387* (2013.01)

(58) Field of Classification Search
CPC ... F41G 3/142; F41G 3/14; F41G 3/16; F41G 3/165; F41G 3/00; F42B 12/387; F42B 12/38
USPC ... 89/41.17, 41.01, 41.02, 41.05, 41.06, 1.1; 102/513, 501, 473, 293, 458
See application file for complete search history.

(56) References Cited

U.S. PATENT DOCUMENTS 3,685,159 A * 8/1972 Erhard ..... F41G 3/06 89/204
3,757,632 A * 9/1973 Bellinger ..... F42B 12/387 102/336
3,798,795 A * 3/1974 Michelsen ..... F41G 3/2611 434/19
3,840,794 A * 10/1974 Clement ..... F41G 3/06 318/600

(Continued)

FOREIGN PATENT DOCUMENTS

EP 0261091 A2 * 3/1988 ..... F41G 3/142
GB 2107835 A * 5/1983 ..... F41G 3/142

*Primary Examiner* — Jonathan C Weber
(74) *Attorney, Agent, or Firm* — Robert W. Morris; Eckert Seamans Cherin & Mellot, LLC

(57) ABSTRACT

A system for correcting the aim of a weapon which is operative to launch a projectile from a barrel on a ballistic path toward a target. A rear surface of the projectile is coated with a fluorescent dye that re-emits radiation when excited by laser radiation. The system includes a source of laser radiation (strobe) pulses that form a cone of light intersecting the ballistic path of the projectile. The strobe pulses are emitted at predetermined times (T1, T2, T3, . . . Tn) following firing of the projectile (at time T0). An optical detector receives the radiation re-emitted by a the fluorescent dye at the rear of the projectile at times (T1*z*, T2*z*, T3*z*, . . . Tnz) producing measurable location signals allowing the system to measure the vertical and lateral positions of the projectile at said times, where "z" is a re-emission delay and T1*z*, T2*z*, T3*z*, . . . Tnz are the respective times T1, T2, T3, . . . Tn each delayed by amount z.

13 Claims, 9 Drawing Sheets

(56) References Cited

U.S. PATENT DOCUMENTS 4,015,258 A * 3/1977 Smith ..... F41G 3/06 342/119
4,020,407 A * 4/1977 Clement ..... F41G 3/06 318/601
4,698,489 A * 10/1987 Hickin ..... F41G 3/323 235/407
5,140,329 A * 8/1992 Maughan ..... F41G 3/142 342/67
5,259,567 A * 11/1993 Jano ..... G01D 5/345 244/3.11
5,456,157 A * 10/1995 Lougheed ..... F41A 17/08 348/143
5,596,509 A * 1/1997 Karr ..... F41J 5/10 235/411
5,686,690 A * 11/1997 Lougheed ..... F41A 17/08 348/155
6,038,955 A * 3/2000 Thiesen ..... F41G 3/142 89/41.06
6,260,466 B1 * 7/2001 Humphreys ..... F41G 3/08 89/41.03
6,499,382 B1 * 12/2002 Lougheed ..... F41G 3/06 89/41.05
6,880,467 B1 * 4/2005 Knapp ..... F42B 12/36 102/293
7,735,423 B1 * 6/2010 Gold ..... F42B 12/36 102/458
8,074,555 B1 * 12/2011 Sullivan ..... F41G 3/142 89/200
8,402,896 B1 * 3/2013 Hollerman ..... F42B 12/40 102/458
8,499,693 B2 * 8/2013 Sullivan ..... F42C 17/04 102/213
8,794,119 B2 * 8/2014 Shulman ..... F41G 3/04 89/41.01
2002/0053278 A1 * 5/2002 Hayes ..... B63C 9/26 89/1.34
2004/0050240 A1 * 3/2004 Greene ..... F41G 3/06 89/41.06
2007/0243504 A1 * 10/2007 Bjorkman ..... F41G 3/265 434/22
2011/0107935 A1 * 5/2011 Authement, Sr. ..... F42B 7/046 102/458
2011/0297742 A1 * 12/2011 Sullivan ..... F41G 1/54 235/407
2016/0209188 A1 * 7/2016 Nugent, Jr. ..... F42B 12/387

* cited by examiner

APPARATUS FOR CORRECTING BALLISTIC AIM ERRORS USING SPECIAL TRACERS

CROSS-REFERENCE TO RELATED APPLICATIONS

This application is a continuation of copending application Ser. No. 14/220,404, filed Mar. 20, 2014, ("Parent Application") and claims priority from said Parent Application and the U.S. Provisional Application No. 61/803,826 filed Mar. 21, 2013.

BACKGROUND OF THE INVENTION

The present invention relates to weaponry and fire control. More specifically, it relates to an ammunition projectile and a fire control device for tracing the path of a projectile while in ballistic flight toward a given target, so as to improve precision and accuracy when aiming a subsequent projectile at the same or another target.

The U.S. Pat. No. 8,074,555 discloses a system for tracking the lateral drift and vertical drop of an ammunition projectile while in flight to provide a precise aim point for firing one or more subsequent projectiles. With this system, a projectile is provided with an optical emitter, in the rear of the projectile housing, which produces optical strobe signals at predetermined times (T1, T2, T3 . . . ) following firing of the projectile (at time T0). An optical detector receives the optical signals and an image processor determines the lateral drift (i.e. X1, X2, X3 . . . ) and vertical drop (i.e. Y1, Y2, Y3 . . . of the projectile at the predetermined times (T1, T2, T3 . . . ) following time T0. The subject matter of this patent is incorporated herein by reference.

This system uses the real time data to correct for aiming errors due to gun jump, wind turbulence, altitude-dependent wind conditions, lot-to-lot ammunition irregularities, bore sight misalignment and the like, for use when firing subsequent projectiles. This system is optimized to function with projectiles that have adequate energy to power LED's to emit strobe light and where the ballistic trajectory angles are significant (e.g., with mortars, artillery and 40 mm systems).

SUMMARY OF THE INVENTION

The principal object of the present invention is to improve the precision and accuracy of weaponry systems by taking into account all the factors that affect the actual ballistic flight of a projectile.

It is another object of the present invention to improve the fire control device of the type disclosed in the U.S. Pat. No. 8,074,555 to render it more reliable and less expensive.

It is still another object of this invention to improve the fire control device disclosed in the U.S. Pat. No. 8,074,555 to minimize power consumption of projectile-borne batteries, used for example in projectile fuses, and simplify the sensor array (detector) that views the projectile.

These objects, as well as still further objects which will become apparent from the discussion that follows, are achieved, in accordance to the present invention by providing an otherwise conventional ammunition projectile with a coating of fluorescent dye material, on or near its rear surface, whereby the dye re-emits radiation in response to excitation by laser light.

The fluorescent dye, optimized to luminance in response to laser radiation, exploits a natural phenomenon known as "laser-induced-fluorescence." The dye is coated on an external rear surface of the projectile. The coating is preferably covered by a transparent shield or coating and, for example, it may be disposed on the inside surface of a transparent window on the rear of the projectile.

The present invention also provides a system for correcting the aim of a weapon that is operative to launch such a projectile on a ballistic path toward a target. The aim-correcting system preferably includes the following components:

(1) a source of short (strobe) radiation pulses directed toward the ballistic path of the projectile for excitation of the fluorescent dye material on the projectile, such pulses being emitted at predetermined times (T1, T2, T3 . . . ) following firing of the projectile (at time T0);

(2) a radiation detector for receiving strobe radiation re-emitted by the fluorescent dye on the projectile allowing for the vertical and lateral measurement of the projectile's position at times (T1*z*, T2*z*, T3*z* . . . ), where "z" is the time delay of re-emission after excitation;

(3) a signal processor, coupled to the radiation detector, for processing the electronic signals produced by the detector to determine the lateral (X) and vertical (Y) coordinates of the projectile at such times (T1*z*, T2*z*, T3*z* . . . ) during flight;

(4) a computer, coupled to the processor, for calculating a lateral correction and a vertical correction in the aim of the weapon; and (5) an output device, coupled to the computer, for facilitating an adjustment in the aim of the weapon toward the target, prior to firing the next projectile.

Using this aim-correcting device the aim of the weapon may be adjusted after the launch of one projectile to compensate for aiming errors prior to the next launch of a projectile.

By means of this system, either the signal processor or the computer calculates the lateral drift and the vertical drop of the projectile at the predetermined times.

Preferably the radiation source is laser source adapted to be affixed to the weapon so that the cone of illumination of the laser source intersects with the ballistic path of the projectile and excites the photo-luminescent material.

Preferably the radiation detector is a digital camera for producing an image of the ballistic path of the projectile. Depending upon the type of fluorescent dye material, the frequency of the excitation radiation may be in one of the UV, visual and IR spectral bands.

Both the laser source and radiation detector may utilize narrow pass filters that provide for stealth in illuminating the projectile and simplified signal processing and optical detector construction as the technique provides for optimized signal to noise ratios.

The radiation source preferably includes a narrow band-pass filter for selectively passing a narrow spectrum of laser light to the projectile to excite the fluorescent dye. The radiation detecting device preferably also includes a narrow band pass filter allowing only the re-emitted light from the fluorescent dye to pass to the detector, thereby minimizing the data processing required of the detector output.

The output device of the system may be a display for the operator who manually adjusts the aim in the weapon's bore sight or it may automatically adjust the aim of the weapon, for example by passing the projectile drift and drop data to the fire control device of the weapon.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
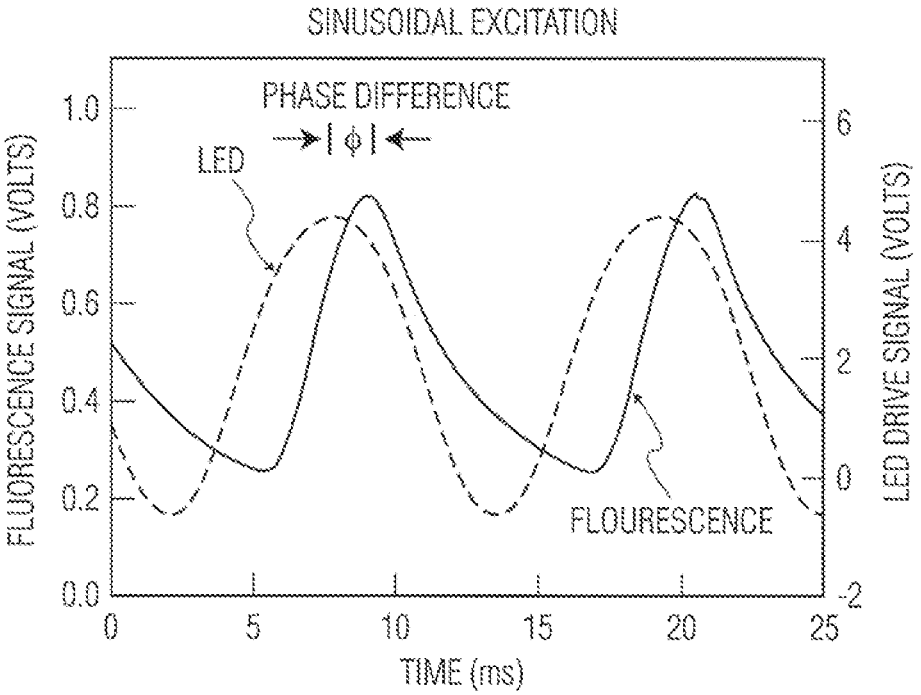
FIG. 1 is a time diagram of laser induced fluorescence showing the delay in response to excitation.

The preferred embodiments of the present invention will now be described with reference to FIGS. 1-12 of the drawings. Identical elements in the various figures are designated with the same reference numerals.

The invention provides for a method and arrangement to collect optical location signals emitted by a projectile in flight fired from a weapon while simultaneously recording movement and/or acceleration. These optical signals are transmitted from a projectile in flight in either the visual, ultraviolet and infra-red spectrum. The signals are re-emitted from the projectile at predetermined times (T1*z*, T2*z*, T3*z*, etc.) following the time of firing (T0). An optical detector incorporated into the weapon launcher or on an associated platform detects the angular geometry (projectile location in the sky) of the radiation re-emitted by the photo-luminescent material on the projectile as well as the duration (time length) of this re-emitted strobe in its field of view.

FIG. 1 is a time diagram illustrating the time delay of fluorescence in response to excitation by laser light. As may be seen, there is a delay of about 3 milliseconds between excitation and response. This period of delay is designated hereinafter by the letter "z".

The operating sequence of the system according to the invention is depicted in Table 1 below.

TABLE 1

| Sequence of Measurements<br>Sequence of Measurement Methodology | |
|---|---|
| T0 − a | Fire Control Displays solution based on solution derived from algorithm (based on previous measurement) |
| T0 − b | Measurement of (a) radial Azimuth/Elevation Barrel Centerline and (b) elevation of barrel/fire control if not aligned |
| T0 − c | Firing Pin Trigger pull (or hammer fall sensor) where a, b and c are lengths of time before T0 |
| T0 | Set Back of Cartridge Launch |
| T1 | Laser emits short pulse |
| T1 + z | Response of dye on projectile time z later |
| T1 + z | Camera image (x1, y1) of strobe response and camera position (xx1, yy1) |
| T2 | Laser emits short pulse |
| T2 + z | Response of dye on projectile time z later |
| T2 + z | Camera image (x2, y2) of strobe response and camera position (xx2, yy2) |
| T3 | Laser emits short pulse |
| T3 + z | Response of dye on projectile time z later |
| T3 + z | Camera image (x3, y3) of strobe response and camera position (xx3, yy3) |
| Tn + z<br>etc. | Camera image (xn, yn) of strobe response and camera position (xxn, yyn) |

Figure 2:
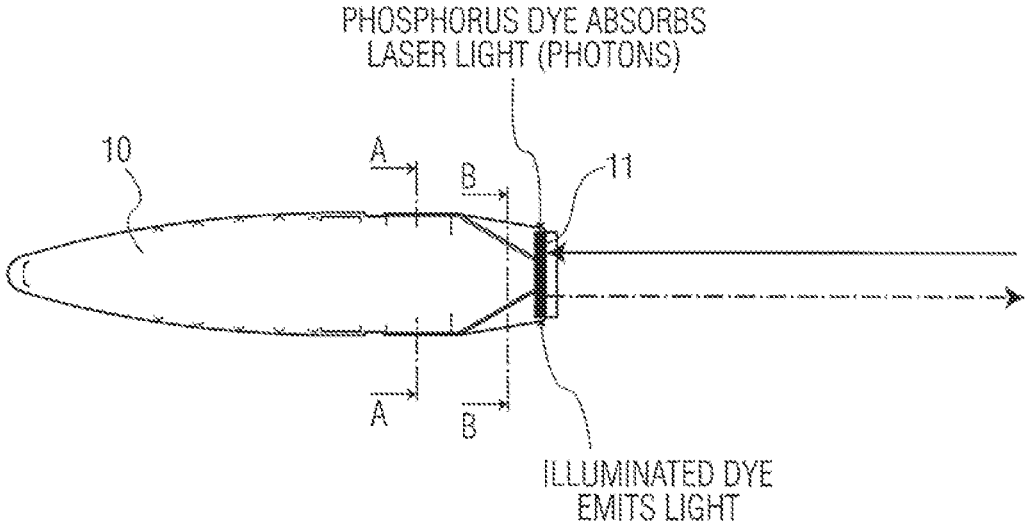
FIG. 2 is a representational diagram showing an ammunition projectile having a fluorescent dye at its rear surface.

FIG. 2 shows an ammunition projectile 10 having a fluorescent dye 11 applied to its rear surface. The fluorescent dye preferably has a transparent or translucent coating to protect against damage or it is covered by a plastic shield or the like attached to the rear of the projectile.

The system according to the invention has the capability to detect the laser-induced fluorescence ("LIF") of a projectile while in flight. The re-emission in response to the LIF occurs the short period of time (z) after transmission of the laser strobe excitation.

When a phosphor is included with the projectile dye, the system can utilize phosphor thermometry. By measuring this re-emitted light duration (z) the system can use temperature differences observed on projectiles in flight to further differentiate between and among the locations of multiple projectiles when the rate of fire is such that multiple projectiles are in flight at the same time.

Figure 3:
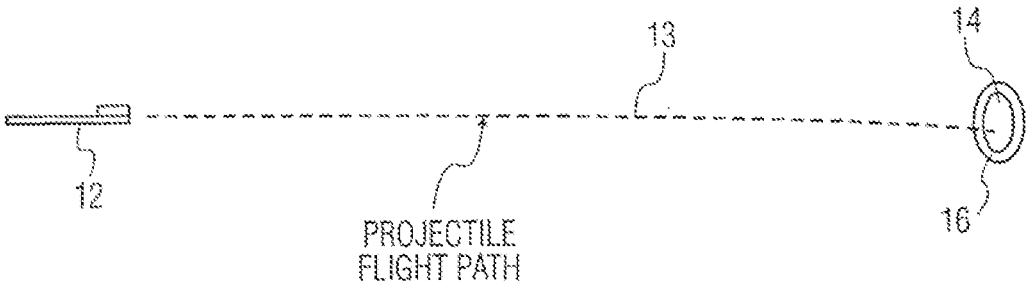
FIG. 3 is a diagram showing a weapon and the trajectory of a projectile fired from a weapon.
Figure 4:
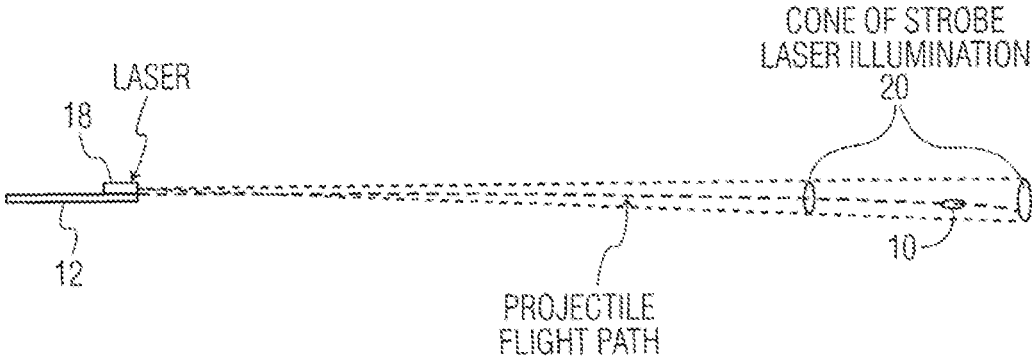
FIG. 4 is a diagram showing a cone of illumination of strobe light emitted by a laser source that intersects the ballistic flight path of a projectile fired from a weapon. The laser aim is slightly depressed from the bore sight for optimized intersection with the projectile's trajectory within the dispersion of the light cone.
Figure 5:
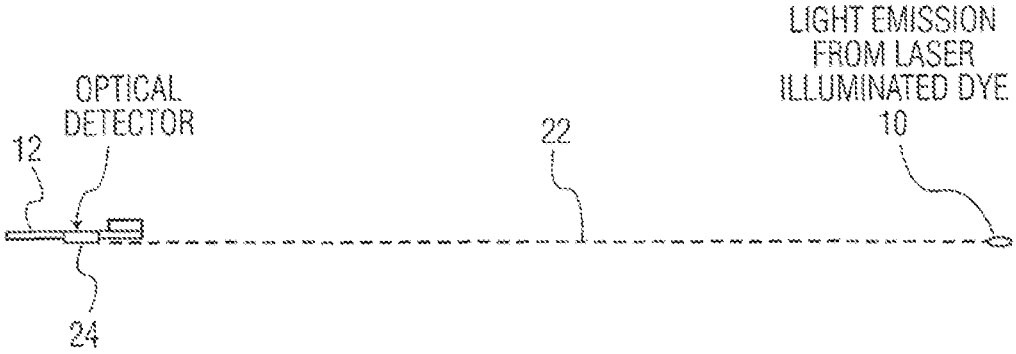
FIG. 5 is a diagram showing an optical detector which receives a light emission from a laser-illuminated fluorescent dye on an ammunition projectile.
Figure 6:
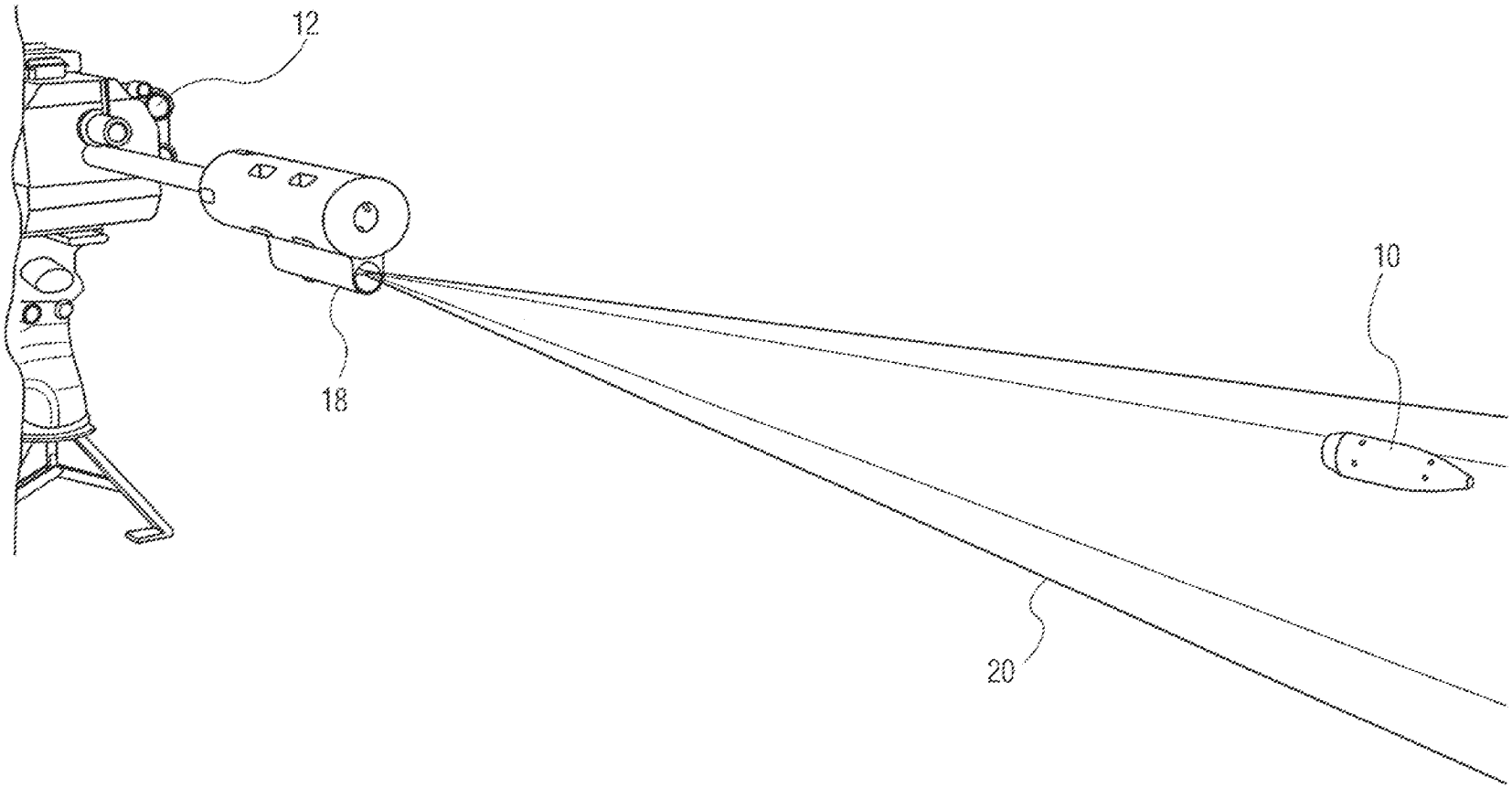
FIG. 6 is a perspective view of a weapon having a laser source to illuminate a projectile in flight.

The system of the present invention is shown generally in FIGS. 3, 4 and 5. FIG. 3 shows a weapon 12 capable of firing projectiles in the direction of a target 14. The projectiles impact in the region of the target in a dispersion zone 16. FIG. 4 shows a laser source 18 mounted on the barrel of the weapon emitting pulses (strobes) of light in a cone of illumination 20 that intersects the projectile 10. FIG. 5 shows light 22 re-emitted by the fluorescent dye 11 on the projectile 10, reaching an optical detector 24 on or near the weapon 12. This arrangement is illustrated in perspective in FIG. 6

The laser strobe emits light at precise time intervals after launch or cartridge setback. The weapon fire control system compares the actual flight position at these precise post-firing intervals to the location that is forecasted by the original solution algorithm. The "delta" positions are recorded (stored/registered) and the fire control provides a gunner with new "corrected" aim points using the registered shots.

The optical signals emitted by the fluorescent dye material on the projectile are collected by an optical detector, such as an IR camera, co-located with the weapon. The image is digitally processed and X and Y coordinates of the projectile's strobe signal are identified by collection at the predetermined time intervals. When a gunner subsequently wishes to engage new targets, the computer associated with the system uses an algorithm to identify a precise aim point solution using the observed trajectory of previous shots, thereby re-measuring and re-calibrating the distance and relative target elevation for subsequent firing of the weapon.

Optical emissions include light in the ultraviolet, infra red and visual wavelengths. The weapon's fire control unit has the capability to emit a cone of light (modulated to strobe at a set time) that intersects with the ballistic path of the projectile. Normally, the laser emission will be aligned vertically. The laser's horizontal alignment will drop slightly at an inclination so the top edge of the laser light illumination cone is aligned horizontally with the centerline of the barrel. This geometry allows the laser light cone to cover the entire ballistic drop of the projectile.

The laser emitter 18 transmits a short, intense light strobe signal at predetermined times after set back during the flight path of the projectile. This occurs at T1=(time of emission+z), T2=(time of emission+z), T3=(time of emission+z), Tn=(time of emission+z) where z is the time delay in milliseconds. Using this technique it is possible to select dye combinations where the laser strobe transmits strobe signals at a given frequency and the dye's optical response differs in its response frequency. This is used by the optimize system to preclude detection by potential adversaries. It is possible, in fact, to harness the heat of the projectile to change the spectral response of the dye.

The transmission of electromagnetic (optical) signals differs under certain atmospheric conditions and frequencies. The delay (z) between the laser's production of a light strobe and the tracer's fluoresced re-emitted response, as well as the length (duration) of the response signal, are used by the fire-control detection software to eliminate detection of stray reflective light that occurs when the laser beam strobe signal reflects off of objects and to distinguish between multiple projectiles.

Projectile flight geometry provides for reflection of light rearward to the gunner's position at pre-set intervals though the entire flight path. The fire control device associated with the weapon optically identifies the position (T1=position x1,y1, T2=position x2,y2, T3=position x3, y3, . . . Tn=position xn, yn) of the projectile at set intervals.

The invention provides for a system to collect optical location signals from a projectile in flight which are excited by an optical light source (visual, ultraviolet and infra-red). The fire control uses observed time-location and angular observation data to compute an improved ballistic solution.

The system allows the fire control computers to readily observe and calculate fire control solutions that reduce or eliminate (1) occasion-to-occasion errors, (2) ammunition lot-to-lot errors, and (3) bore sight misalignment.

Fire control computers can readily adjust aim points using sensors to measure air temperature, pressure, firing geometry and standard muzzle velocities; however, practical considerations still limit the accuracy of calculated solutions. Lot-to-Lot ammunition variations along with occasions-to-occasion errors still result in limitations in the accuracy of fire control solutions. These errors also include those errors that result from varying wind conditions. Hence, measurement of the actual observed projectile drift and drop is necessary to allow fire control systems to provide improved aiming solutions.

Figure 7:
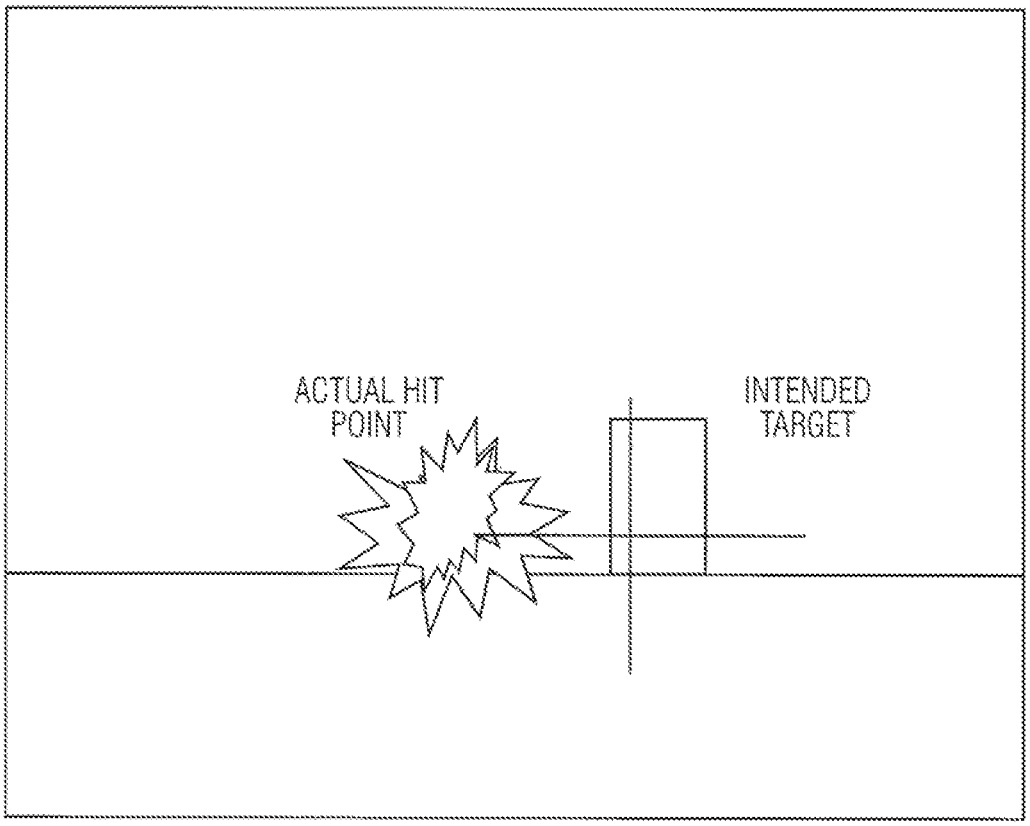
FIG. 7 is a representational diagram showing an error imparted by a fire control device which uses ballistic tables and metrological sensors to calculate a predicted hit point (gunner aiming point).

The current generation of fire-control devices use ballistic tables and metrological sensors to calculate a predicted hit point (gunner aiming point). Some fire control systems allow users to input manual drift and elevation offsets, but these manual offsets are generally linear. Hence, the current generation fire control devices continue to provide inaccurate aim points due to the fact that they only calculate a limited number of inputs while many "unsolved" sources of errors are not factored in. Unsolved errors include (a) bore sight misalignment, (b) lot-to-lot errors, (c) occasion-to-occasion errors and (d) limitations in existing wind sensor technology. All unsolved errors degrade the accuracy and precision of weapon fire control solutions, as illustrated in FIG. 7

Figure 8:
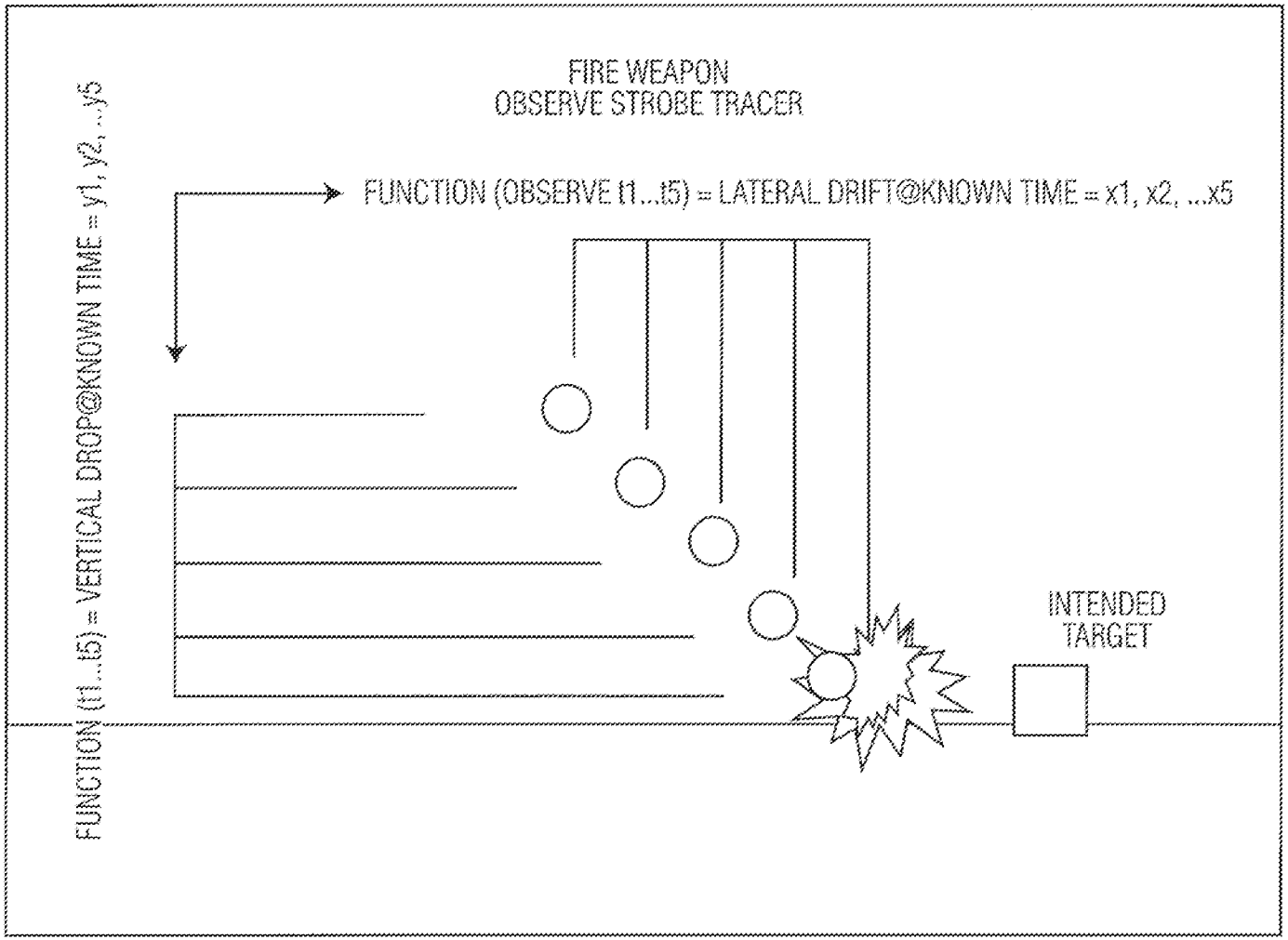
FIG. 8 is a representational diagram showing how the system of the present invention identifies the X and Y location of the detected fluorescent dye strobe signal against the sky or backdrop.

The projectile's stimulated dye response occurs at discrete intervals (at T1+z, T2+z, T3+z, . . . Tn+z, where z is the response delay) that are observed by fire control devices equipped with optical sensors. The dye's strobe response to laser illumination identifies the position of the projectile at set time intervals after set-back (time T0). As illustrated in FIG. 8, the system according to the invention optically collect the strobe light emissions at predetermined post firing (post set-back or launch) time windows. The projectile's fluorescent dye emits light strobe pulses that are collected by the optical detector 24 (e.g. a camera) and digitally recorded. At each pre-set time window the device also records changes in the X and Y orientation of dye emission. The system's image processing software measures or signal processing algorithms calculate the X and Y location of the optical strobe emission at the pre-set time window.

Figure 9:
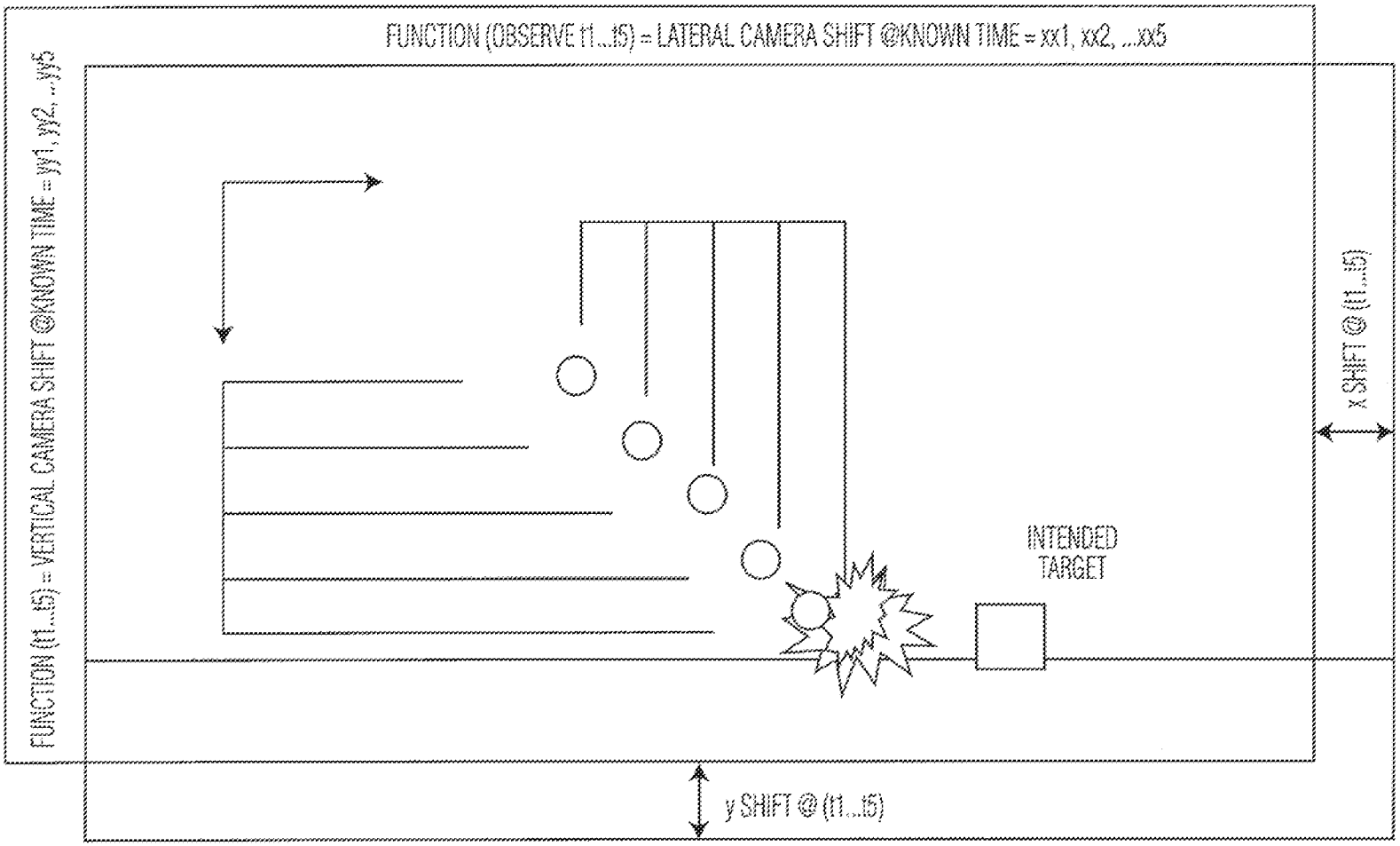
FIG. 9 is a representational diagram showing how the system of the present invention uses the laser-induced and emitted strobe signal to correct for the actual drift in the azimuth and inaccuracy in the ballistic fall of fired projectile (the view from fire control device at gunner's position).
Figure 10:
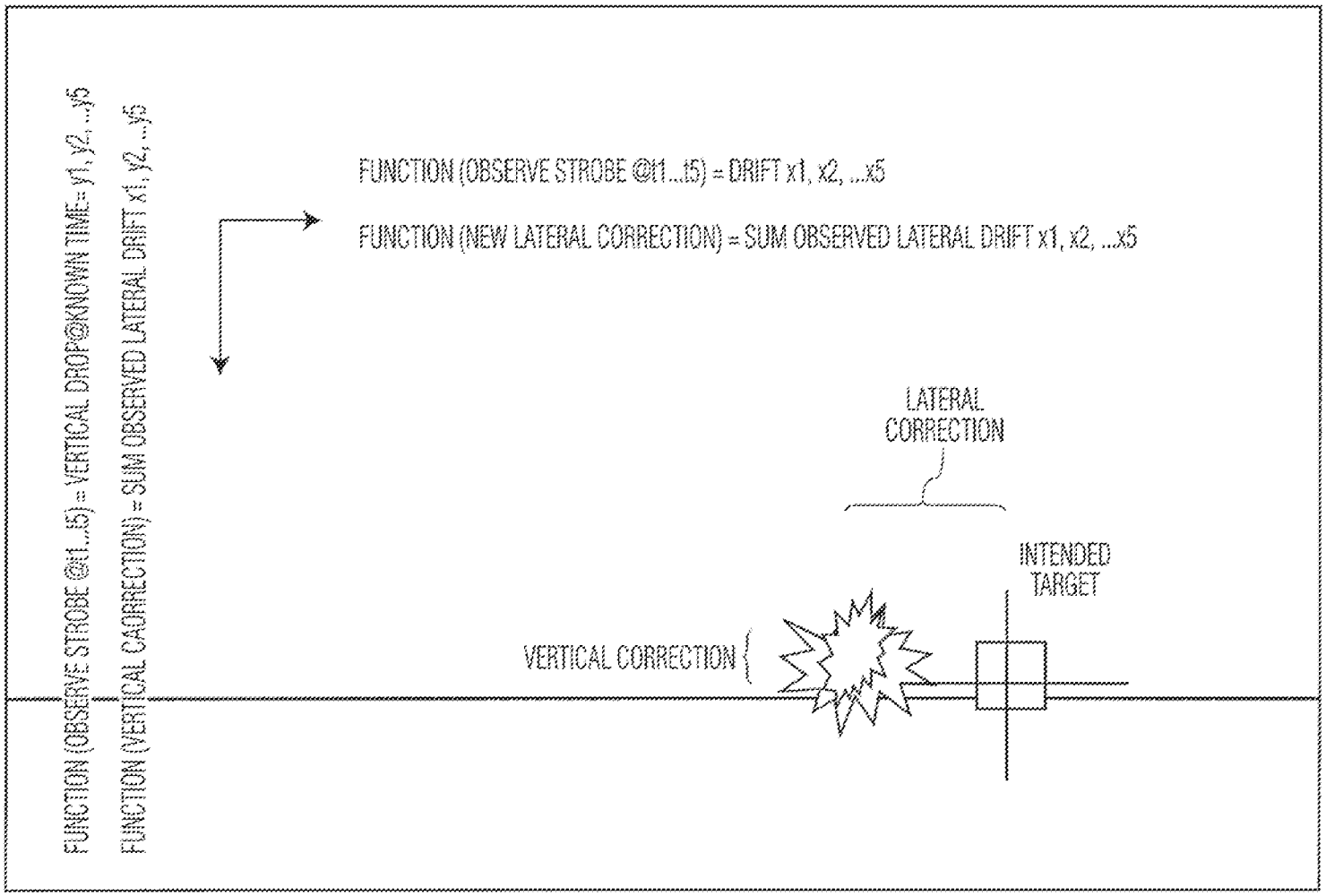
FIG. 10 is a representational diagram showing how the system of the present invention is used, post firing, to shift fields of view. The system measures the angular changes of the platform or camera at the same moment that the tracer's strobe signal is detected.

The system's signal processor identifies the X,Y location of the detected dye strobe signal against the sky or backdrop, as shown in FIGS. 9 and 10, thereby determining the actual drift and drop of the projectile 10 as seen from the gunner's position.

The measurement of observed projectile drift and vertical drop are obtained by an image processor to isolate the strobe tracer's position. Simultaneously, angular changes in the detector are measured. The image processor search and detects the strobe images at pre-set intervals after firing. Alternatively, the signal processor detects the signal at pre-set intervals after firing.

Post firing resonance can create shifting fields of view. The system measures the angular changes of the platform or optical detector (camera) at the same moment that the projectile's strobe signal is recorded.

After detecting the actual observed azimuth drift and drop of a cartridge (FIG. 9), a weapon's fire control system can utilize two methods to provide improved fire control solutions. The fire control system can (1) reset subsequent fire control solutions to use actual observed drift and drop, or (2) establish a correction factor which modifies the calculated fire control solution. Hence, use of actual observed data provides for a more accurate fire control solution.

Fire control computer calculates a new fire control solution after measuring actual drift and drop of an observed "strobe tracer" projectile, as illustrated in FIG. 10.

Figure 11:
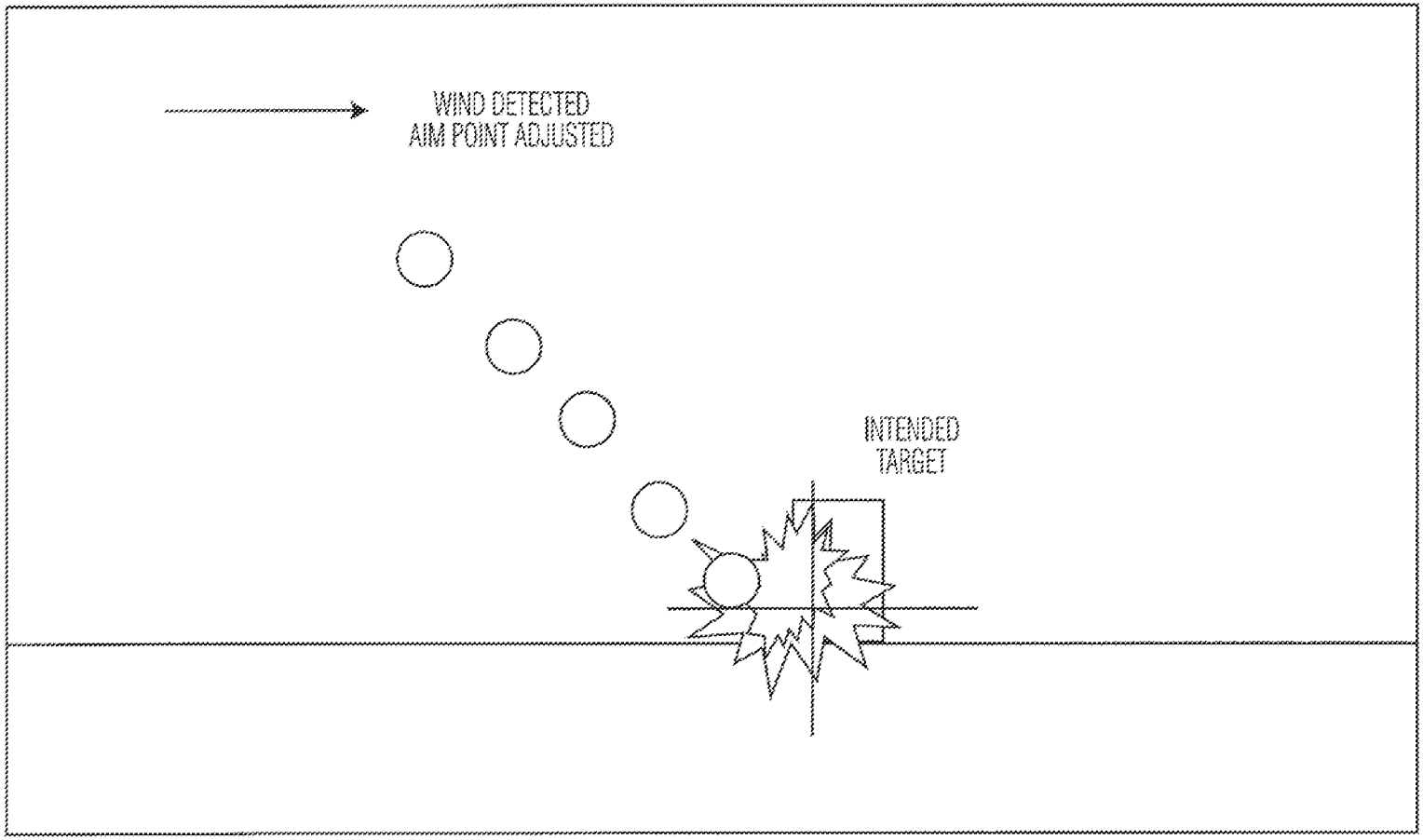
FIG. 11 is a representational diagram showing how the fire control computer calculates a new fire control solution after measuring actual drift and drop of an observed "strobe tracer" projectile.

The diagram of FIG. 11 shows projectile strobe signals from the next subsequently fired projectile as viewed from a gunner's position with the hit point corresponding to aim point.

The system and methodology according to the invention allow fire control devices to adjust the aim point (in azimuth and elevation) so that subsequently fired cartridges hit the intended target by using actual observed azimuth drift and vertical drop. With the actual drift observed by the fire control's optical sensor, the fire control computer calculates improved solutions for new engagements. As subsequent volleys are fired, the fire control may use commonly known mathematical algorithms to further improve the precision of the corrected aim point as it repeatedly measures the actual position of cartridge drift and azimuth with a larger sample size.

In the system shown in FIG. 12 an algorithm computes a solution for bore sight adjustment and/or automatically adjusts the aim point of subsequently fired projectiles. The algorithm develops fire control solutions (aim points) using actual, observed azimuth and elevation.

Figure 12:
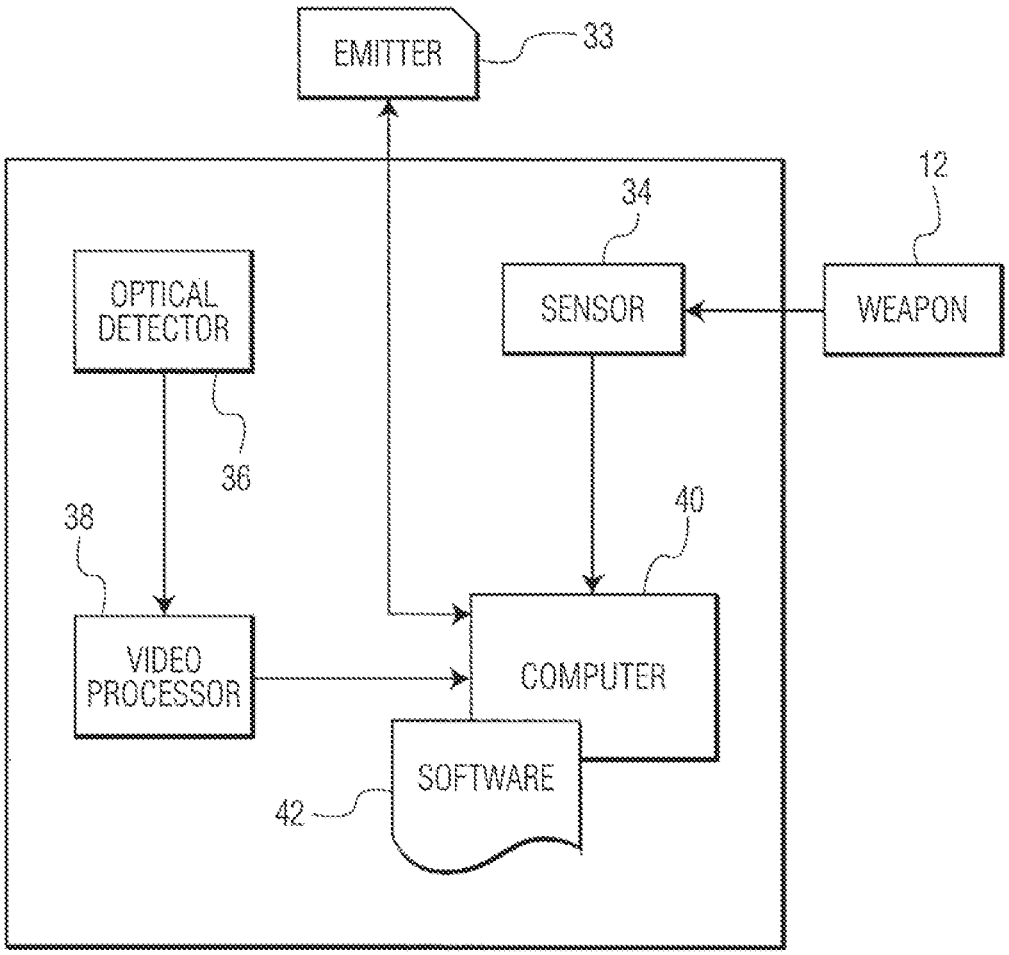
FIG. 12 is a block diagram of the system according to the present invention which uses an algorithm that computes a solution for bore sight adjustment and/or automatically adjusts the aim point of subsequently fired projectiles.

FIG. 12 shows a system 30 according to the invention for a weapon 12 comprising an emitter 33, one or more sensors 34, an optical detector (e.g. camera) 36, a signal processor 38 and a computer 40 operating with software 42.

The sensors 34 are used to identify various parameters of the weapon 12. Such sensors can be of various types, for example, position sensors, sensors for gun elevation, optical sensors and the like. The emitter 33 is a high-powered laser which is triggered by the computer 40 to produce a strobe of light.

The optical detector 40 can be any type of image capturing device, for example a video camera, infrared camera or the like. It produces electronic signals representing the images and passes them to a signal processor 42. The processor 42 determines X,Y location and as well as the time duration of each received response from a projectile in flight. This information is passed to the computer 40 for calculating a lateral correction and a vertical correction in the aim of the weapon 12.

The fire control device measures the angular position of the weapon 12 when the weapon fires a projectile aimed at a target. This angular position information includes a radial azimuth/elevation barrel centerline and elevation of barrel/fire control elevation, The angular position is measured by the sensors 34 and this information is also passed to the computer 40.

The computer determines the drift and drop of the fired projectile and passes this data to the fire control device for adjusting the aim point of for the next projectile to be fired.

The time delay (z) of the re-emitted signal allows the computer 36 to disregard reflections received by the detector 40 from stray objects. The time duration of the re-emitted signal allows the computer to distinguish between multiple projectiles in flight which have been rapidly fired successively by the weapon 12. Closer (and therefore hotter) projectiles will have shorter duration re-emissions that the projectiles that are further away (and therefore cooler).

There has thus been shown and described a novel apparatus for correcting ballistic errors using laser induced fluorescent (strobe) tracers which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A system for correcting the aim of a weapon which is operative at the launch of a projectile entering ballistic flight after exiting from a barrel, said aim correcting system comprising—a signal processor, and a coupled radiation emitter and radiation detector with an aligned axis, illuminating the space beyond the muzzle that intersects with the ballistic path of the projectile;

said radiation emitter comprising a source of radiation at the location of the weapon which illuminates the space forward of the muzzle producing measurable optical signals illuminating the changing vertical and lateral positions of one or more projectiles in ballistic flight after being fired from the weapon;

said radiation detector measuring a change in x, y position of each projectile at a plurality of pre-set intervals through the entire ballistic flight path, wherein the change in x, y position is measured based at least in part on a first x, y position measured at a prior pre-set interval of the plurality of pre-set intervals;

said signal processor, coupled to the radiation detector, for processing said electronic signals to determine the spatial (X and Y) coordinates of a projectile during flight, wherein the signal processor calculates a lateral drift and a vertical drop of the projectile by comparing an actual flight position of the projectile and a flight position of the projectile forecasted by a solution algorithm;

wherein said radiation emitter is a laser source, arranged separate and apart from the weapon's targeting optics in the vicinity of the weapon, such that a cone of illumination is emitted from the laser source and the emitted radiation intersects with the ballistic path of the projectiles fired from the weapon.

2. The system defined in claim 1, further comprising an output device, coupled to the radiation detector, for facilitating an adjustment in the aim of the weapon toward the target, prior to firing the next projectile.

3. The system defined in claim 2, further comprising:

a computer, coupled to the signal processor and to the output device, for calculating a lateral correction and a vertical correction in the aim of the weapon;

wherein said output device facilitates the lateral and vertical correction in the aim of the weapon.

4. The system defined in claim 3, wherein one of the signal processor and the computer calculates the lateral drift and the vertical drop of the projectile during its ballistic flight.

5. The system defined in claim 2, wherein the output device displays the lateral and vertical correction in the aim of the weapon.

6. The system defined in claim 2, wherein the output device adjusts the aim of the weapon to impart the lateral and vertical correction.

7. The system defined in claim 2, wherein said output device includes a display.

8. The system defined in claim 7, wherein said output device includes a aiming device allowing an operator to adjust the aim of the weapon.

9. The system defined in claim 1, where said radiation source is a steerable laser so that the laser illumination is emitted to intersect with the ballistic path of the projectile.

10. The system defined in claim 1, wherein the radiation detector is a digital video camera for producing an image of the ballistic path of the projectile.

11. The system defined in claim 1, wherein the radiation detector includes a filter, allowing the emitted radiation from the projectile to be selectively received and other radiation excluded.

12. The system defined in claim 1, wherein the frequency of said radiation source is in one of the UV, visual and IR spectral bands.

13. The system defined in claim 1, wherein the radiation source emits timed radiation signals at specific time intervals.

* * * * *